US010605525B2

(12) United States Patent
Ma et al.

(10) Patent No.: US 10,605,525 B2
(45) Date of Patent: Mar. 31, 2020

(54) CLEANING DEVICE AND CLEANING METHOD

(71) Applicants: BOE TECHNOLOGY GROUP CO., LTD., Beijing (CN); HEFEI BOE OPTOELECTRONICS TECHNOLOGY CO., LTD., Hefei, Anhui (CN)

(72) Inventors: Guanghe Ma, Beijing (CN); Juan Li, Beijing (CN); Yangkun Jing, Beijing (CN)

(73) Assignees: BOE TECHNOLOGY GROUP CO., LTD., Beijing (CN); HEFEI BOE OPTOELECTRONICS TECHNOLOGY CO., LTD., Beijing (CN)

( * ) Notice: Subject to any disclaimer, the term of this patent is extended or adjusted under 35 U.S.C. 154(b) by 1147 days.

(21) Appl. No.: 14/737,592

(22) Filed: Jun. 12, 2015

(65) Prior Publication Data

US 2016/0201984 A1 Jul. 14, 2016

(30) Foreign Application Priority Data

Jan. 13, 2015 (CN) ..... 2015 1 0017019

(51) Int. Cl.
*B08B 3/10* (2006.01)
*F26B 3/28* (2006.01)
(Continued)

(52) U.S. Cl.
CPC ..... *F26B 3/28* (2013.01); *B08B 3/10* (2013.01); *B08B 3/12* (2013.01); *B08B 7/0057* (2013.01)

(58) Field of Classification Search
None
See application file for complete search history.

(56) References Cited

U.S. PATENT DOCUMENTS 4,945,955 A * 8/1990 Murphy ..... B67D 7/725 137/205
5,669,979 A 9/1997 Elliot et al.
(Continued)

FOREIGN PATENT DOCUMENTS

CN 1516565 A 7/2004
CN 1938109 A 3/2007
(Continued)

OTHER PUBLICATIONS

EPO, Patent Translate DE3909016, Jul. 22, 2018, EPO, 3 pages. (Year: 2018).*

(Continued)

*Primary Examiner* — Michael E Barr
*Assistant Examiner* — Jason P Riggleman
(74) *Attorney, Agent, or Firm* — Ladas & Parry LLP; Frank Gao

(57) ABSTRACT

A cleaning device for removing organic liquid residues remaining on a surface of a display substrate, includes a decomposition unit, an atomization unit, a stripping unit and a collection unit; the decomposition unit is configured for changing molecular structures of the organic liquid residues to reduce the adhesive forces of the organic liquid residues on the display substrate; the atomization unit is configured for separating the organic liquid residues which has been treated by the decomposition unit from the surface of the display substrate; the stripping unit is configured for stripping the organic liquid residues which has been treated by the atomization unit from the surface of the display substrate; and the collection unit is configured for collecting the organic liquid residues stripped by the stripping unit.

17 Claims, 3 Drawing Sheets

(51) Int. Cl.
*B08B 3/12* (2006.01)
*B08B 7/00* (2006.01)

(56) References Cited

U.S. PATENT DOCUMENTS

| | | | | |
|---|---|---|---|---|
| 2004/0236392 | A1 | 11/2004 | Dick et al. | |
| 2008/0110205 | A1* | 5/2008 | Adriaansen | B65G 49/065 65/29.12 |
| 2012/0044445 | A1* | 2/2012 | Monma | G02F 1/1345 349/123 |

FOREIGN PATENT DOCUMENTS

| | | | | |
|---|---|---|---|---|
| CN | 201093595 | | 7/2008 | |
| CN | 103008311 | A | 4/2013 | |
| DE | 3909016 | A1 * | 9/1990 | B08B 3/123 |
| DE | 3909016 | A1 | 9/1990 | |
| DE | 4009721 | A1 | 10/1991 | |
| WO | WO2009/152885 | A1 * | 12/2009 | |

OTHER PUBLICATIONS

University of Hamburg, Liquid Crystal Display Fabrication, Feb 1, 2001, University of Hamburg, 6 paragraphs discussing pumps including date stamp (Year: 2001).*

Pfeiffer Vacuum, Screw vacuum pumps, Apr. 22, 2009, Pfeiffer Vacuum pumps, 5 paragraphs and 1 figure discussing pumps including date stamp (Year: 2009).*

M. Bender et al, Hepta 100/200/300-/P Screw Pump, 2011, Pfeiffer Vacuum, 3 paragraphs and 2 figures, discussing pumps (Year: 2011).*

First Chinese Office Action Appln. No. 201510077019.1; dated Mar. 3, 2016.

* cited by examiner

CLEANING DEVICE AND CLEANING METHOD

TECHNICAL FIELD

The embodiments of the invention relate to a cleaning device and a cleaning method.

BACKGROUND

Liquid crystal displays (LCDs) have become predominating products of existing flat panel displays because of their small volume, low power consumption, non-radiation and other features. Display panel is a main display component of the liquid crystal display, and typically comprises an array substrate and a color film substrate which are mounted oppositely.

During the manufacture, organic liquid impurities commonly remain on the surfaces of the array substrate and color film substrate. The main sources of the organic liquid impurities remaining on the surfaces of the array substrate and color film substrate are lubricants between components of the device, or oily foulings created in conducts of the cleaning device as a result of longterm use, which falls onto the surfaces of the substrates during the manufacture of the substrates. The oily impurities have commonly a poor hydrophilicity and cannot be removed by deionized water cleaning and atomized organic residue gas drying during the manufacture.

Currently, there are mainly two repair methods for the residue impurities on the color film substrate and array substrate. Hereinafter, the color film substrate will be described mainly as an example. One method is grinding the solid residue particles by using a grinding strip, and this method requires firstly measuring the height of the residue particles by the use of contact type sensors. When this method is used for the repair of the liquid residues on the surface of the color film substrate, the area of the liquid residues on the color film substrate would be further enlarged, which is directly resulted from this contact type height measuring method, thereby causing more surface area of the color film substrate being contaminated by the liquid residues. The other method is destroying those color films at the positions containing the residues by using a laser of a certain wavelength and then coating dye water on the laser radiated positions, and this method is suitable for the repair of solid residue particles embedded inside of the color film. However, liquid residues remaining on the surface of the color film substrate are matters attached on the color film. This laser repair method will break down the normal color film layer, and chips created during the laser repair would be attached on the surface of the color film and form floating particles, thereby influencing the quality of the color film substrate.

Therefore, the liquid residues on the surfaces of substrates can not be effectively repaired by those repair methods of residues which are widely employed currently.

SUMMARY

An embodiment of the present invention provides a cleaning device for removing organic liquid residues remaining on a surface of a display substrate, which comprises a decomposition unit, an atomization unit, a stripping unit and a collection unit;

the decomposition unit being configured for changing the molecular structures of the organic liquid residues, such as breaking down the C—C bonds of the organic liquid residues, transforming oxygen in air to free radicals and thereby forming hydrophilic groups such as hydroxyl groups, etc, or even forming carbon dioxide, water and other small molecules, to reduce the adhesive forces of the organic liquid residues on the display substrate;

the atomization unit being configured for separating the organic liquid residues which has been treated by the decomposition unit from the surface of the display substrate;

the stripping unit being configured for stripping the organic liquid residues which has been treated by the atomization unit from the surface of the display substrate;

the collection unit being configured for collecting the organic liquid residues stripped by the stripping unit.

In one embodiment, the decomposition unit uses an extra-ultraviolet light source for emitting extra-ultraviolet light to the organic liquid residues. The extra-ultraviolet light can break down the molecular chains of the organic liquid residues. During the decomposition of the molecules of the organic liquid residues, the extra-ultraviolet light would neither damage the substrate, nor enlarge the area of the residues obviously, thus the disadvantages of those cleaning methods have been overcome.

In one embodiment, the extra-ultraviolet light emitted by the extra-ultraviolet light source has a wavelength range of 10 to 40 nm.

In one embodiment, the decomposition unit comprises a plurality of the extra-ultraviolet light sources arranged in a matrix or arranged uniformly in a circular region.

In one embodiment, the atomization unit uses an ultrasonic atomizer or an electrostatic atomizer;

the ultrasonic atomizer being configured for transmitting ultrasonic wave to the organic liquid residues so as to separate the organic liquid residues from the surface of the display substrate under the vibration action of the ultrasonic wave; and the electrostatic atomizer being configured for charging the surface of the display substrate and the organic liquid residues with electrostatic charges of a same polarity so as to separate the organic liquid residues from the surface of the display substrate under the action of electrostatic repulsion.

In one embodiment, the stripping unit uses a spiral separator which comprises a screw, a chamber sleeved out of the screw and a motor, the chamber having an inlet and an outlet which correspond to two ends of the screw respectively; and the inlet being configured for being arranged towards the organic liquid residues, the motor being configured for rotating the screw around its axis such that the gas stream in the chamber flows from the inlet to the outlet and a negative pressure is formed in the chamber; the spiral separator being capable of sucking the organic liquid residues under the action of the negative pressure in the chamber from the inlet and discharging the same through the outlet.

In one embodiment, the stripping unit uses a plurality of the spiral separators arranged in an array or arranged uniformly in a circular region.

In one embodiment, the collection unit uses a transparent collection box which is connected with the outlet through a pipe such that the organic liquid residues discharged from the outlet can enter the transparent collection box through the pipe.

In one embodiment, the transparent collection box can be disassembled, or alternatively, the transparent collection box is connected with a discharge pipe for the organic liquid residues, such that the organic liquid residues collected in the transparent collection box can be discharged through the discharge pipe.

In one embodiment, a control unit and a driving mechanism are further comprised, the driving mechanism being connected with the decomposition unit, the atomization unit and the stripping unit respectively for driving the decomposition unit, the atomization unit and the stripping unit to move along the surface of the display substrate; and the control unit being configured for controlling the driving mechanism, according to the position of the organic liquid residues on the display substrate, to drive the decomposition unit, the atomization unit and the stripping unit successively to move to the position just above the organic liquid residues; and controlling the driving mechanism to drive the decomposition unit, the atomization unit and the stripping unit successively to move away from the position just above the organic liquid residues after the organic liquid residues have been treated by the decomposition unit, the atomization unit and the stripping unit.

An embodiment of the present invention further comprises a cleaning method for removing organic liquid residues remaining on a surface of a display substrate, which comprises:

Step S1: changing the molecular structures of the organic liquid residues to reduce the adhesive forces of the organic liquid residues on the display substrate;

Step S2: separating the organic liquid residues from Step S1 from the surface of the display substrate;

Step S3: stripping the organic liquid residues from Step S2 from the surface of the display substrate; and Step S4: collecting the organic liquid residues stripped from the surface of the display substrate in Step S3.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from the following detailed description.

BRIEF DESCRIPTION OF THE DRAWINGS

The present invention will become more fully understood from the detailed description given hereinafter and the accompanying drawings which are given by way of illustration only, and thus are not limitative of the present invention and wherein.

DETAILED DESCRIPTION

To make the object, technical solutions, and advantages of the present invention clearer, the technical solutions of the embodiments of the present invention will be described below in a clearer and more complete way with reference to the figures of the embodiments of the present invention. Apparently, the embodiments described are only part, rather than all of the embodiments of the present invention. Based on the embodiments of the present invention described, all the other embodiments obtained by a person of ordinary skills in the art without paying inventive work fall into the scope of protection of the present invention.

Example 1

Figure 1:
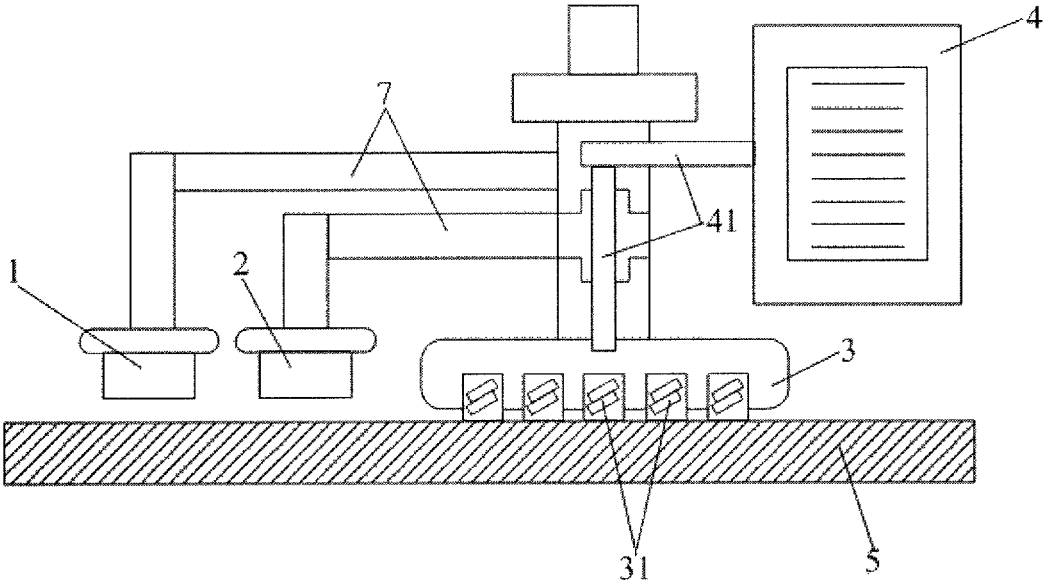
FIG. 1 is a structural schematic diagram of the cleaning device in Example 1 of the present invention.

This example provides a cleaning device, as shown in FIG. 1, for removing organic liquid residues remaining on a surface of a display substrate 5. The cleaning device comprises a decomposition unit 1, an atomization unit 2, a stripping unit 3 and a collection unit 4. The decomposition unit 1 is used for changing the molecular structures of the organic liquid residues to reduce the adhesive forces of the organic liquid residues on the display substrate 5. The atomization unit 2 is used for separating the organic liquid residues which has been treated by the decomposition unit 1 from the surface of the display substrate 5. The stripping unit 3 is used for stripping the organic liquid residues which has been treated by the atomization unit 2 from the surface of the display substrate 5. The collection unit 4 is used for collecting the organic liquid residues stripped by the stripping unit 3.

The cleaning device effectively removes the organic liquid residues from the surface of the display substrate 5 by arranging the decomposition unit 1, the atomization unit 2, the stripping unit 3 and the collection unit 4, thereby improving the quality of the display substrate 5.

In this example, the decomposition unit 1 uses an extra-ultraviolet light source for emitting extra-ultraviolet light to the organic liquid residues. The extra-ultraviolet light can break down the molecular chains of the organic liquid residues. That is, after irradiated by the extra-ultraviolet light, the molecular chains of the organic liquid residues may be broken down under the irradiation action of the extra-ultraviolet light, thereby forming hydrophilic groups, or even forming carbon dioxide, water and other small molecules, thereby changing the molecular structures of the organic liquid residues and the hydrophilicity thereof and consequently reducing the adhesive forces of the organic liquid residues on the display substrate 5, which is favorable for subsequently removing the organic liquid residues from the display substrate 5 easily.

Herein, the extra-ultraviolet light emitted by the extra-ultraviolet light source has a wavelength range of 10 to 40 nm. The extra-ultraviolet light within this wavelength range can better break down the molecular chains of the organic liquid residues, thereby being favorable for subsequently removing the organic liquid residues from the display substrate 5 easily.

In this example, the extra-ultraviolet light source is an extra-ultraviolet LED lamp, and the decomposition unit comprises a plurality of extra-ultraviolet light sources arranged uniformly in a circular region. In such arrangement, the irradiation area of the extra-ultraviolet light sources would be increased such that the extra-ultraviolet light sources can treat and decompose a larger distribution area of organic liquid residues simultaneously in favor of subsequently removing the whole organic liquid residues in a larger area completely.

It is to be noted that the plurality of extra-ultraviolet light sources can also be arranged in a matrix.

In this example, the atomization unit 2 uses an ultrasonic atomizer for transmitting ultrasonic wave to the organic liquid residues so as to separate the organic liquid residues from the surface of the display substrate 5 under the vibration action of the ultrasonic wave. The ultrasonic atomizer can emit ultrasonic wave capable of vibrating the organic liquid residues and the display substrate 5 simultaneously. Under the vibration action, the organic liquid residues can be separated from the surface of the display substrate 5, thereby being favorable for subsequently stripping and removing the organic liquid residues from the display substrate 5 completely.

Figure 2:
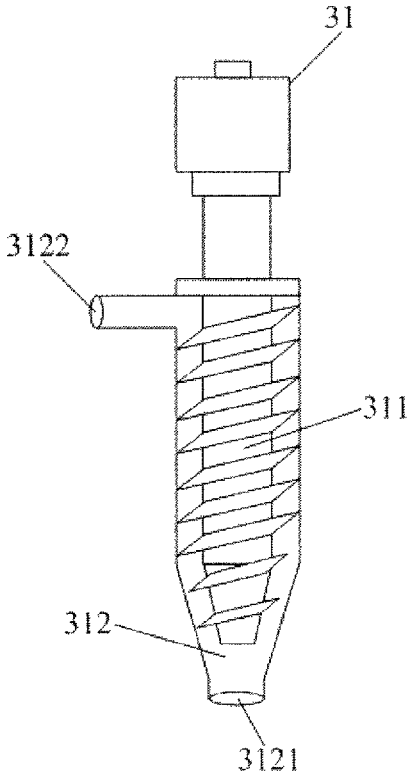
FIG. 2 is a structural schematic diagram of the spiral separator in FIG. 1.

In this example, as shown in FIG. 2, the stripping unit 3 uses a spiral separator 31, which comprises a screw 311, a chamber 312 sleeved out of the screw 311 and a motor (not shown in FIG. 2). The chamber 312 has an inlet 3121 and an outlet 3122 which correspond to two ends of the screw 311 respectively. The inlet 3121 is used for being arranged towards the organic liquid residues. The motor is used for rotating the screw 311 around its axis such that the gas stream in the chamber 312 flows from the inlet 3121 to the outlet 3122 and a negative pressure is formed in the chamber 312. The spiral separator 31 is capable of sucking the organic liquid residues under the action of the negative pressure in the chamber 312 from the inlet 3121 and discharging the same through the outlet 3122. The spiral separator 31 can strip the organic liquid residues from the display substrate 5 completely under the action of the negative pressure created therein, thereby achieving the effective removal of the organic liquid residues on the surface of the display substrate 5.

Figure 3:
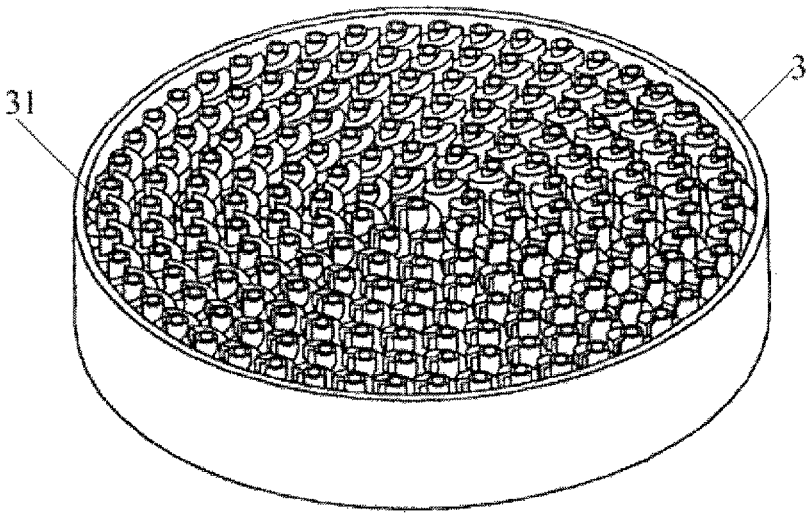
FIG. 3 is a schematic diagram of the arrangement of the plurality of spiral separators in FIG. 1.

In this example, as shown in FIG. 3, the stripping unit comprises a plurality of spiral separators 31 arranged uniformly in a circular region. In such arrangement, the distribution area of the spiral separators 31 would be increased such that the spiral separators 31 can treat and strip a larger distribution area of organic liquid residues simultaneously, thereby achieving the complete removal of the whole organic liquid residues in a larger area.

It is to be noted that the area of the circular region in which the plurality of spiral separators 31 are distributed is the same as that of the circular region in which the plurality of extra-ultraviolet light sources are distributed. That is, the irradiation area of the extra-ultraviolet light sources is the same as the organic liquid residue stripping area of the spiral separators 31 so as to ensure that the organic liquid residues which have been treated and irradiated by the extra-ultraviolet light sources can be immediately stripped from the surface of the display substrate 5 by the spiral separators 31, thereby improving the removal efficiency of the organic liquid residues.

It is to be noted herein that the plurality of spiral separators 31 can also be arranged in a matrix.

Furthermore, it is to be noted that the stripping unit 3 can also use a vacuum separator with a structure substantially similar to the structure of the spiral separator merely with the exception of a filter arranged in the gas flow passage of the vacuum separator. The filter can filter the organic liquid residues stripped from the surface of the display substrate 5 onto a filter sieve and remove them by replacing or cleaning the filter. The arrangement of the filter can avoid the vacuum separator from being contaminated by the organic liquid residues.

In this example, the collection unit 4 uses a transparent collection box which is connected with the outlet 3122 through a pipe 41 such that the organic liquid residues discharged from the outlet 3122 can enter the transparent collection box through the pipe 41. The arrangement of the transparent collection box can enable it to be conveniently observed by naked eyes when the collection box is filled with the organic liquid residues, thereby facilitating a timely emptying and treatment of the organic liquid residues in the transparent collection box.

In this example, the transparent collection box can be disassembled. In such arrangement, the organic liquid residues in the collection box can be facilitated to be emptied in time.

It is to be noted that the transparent collection box can also be connected with a discharge pipe of organic liquid residues for discharging the organic liquid residues collected in the transparent collection box through the discharge pipe. Herein, the discharge pipe is connected directly to a treatment site of the organic liquid residues such that the organic liquid residues can be discharged directly to the treatment site through the discharge pipe, thereby largely facilitating the discharge of the organic liquid residues.

Figure 4:
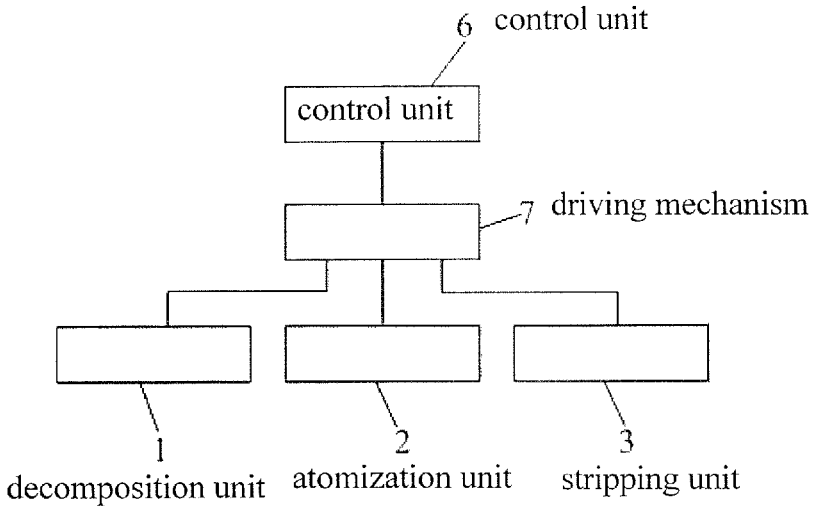
FIG. 4 is a block diagram of a control principle of the control unit in Example 1.

In this example, as shown in FIG. 4, the cleaning device further includes a control unit 6 and a driving mechanism 7. The driving mechanism 6 is connected with the decomposition unit 1, the atomization unit 2 and the stripping unit 3 respectively for driving the decomposition unit 1, the atomization unit 2 and the stripping unit 3 to move along the surface of the display substrate 5. The control unit 6 is used for controlling the driving mechanism 7, according to the position of the organic liquid residues on the display substrate 5, to drive the decomposition unit 1, the atomization unit 2 and the stripping unit 3 successively to move to the position just above the organic liquid residues; and controlling the driving mechanism 7 to drive the decomposition unit 1, the atomization unit 2 and the stripping unit 3 to successively move away from the position just above the organic liquid residues after the organic liquid residues have been treated by the decomposition unit 1, the atomization unit 2 and the stripping unit 3.

Herein, the driving mechanism 7 uses a mechanic arm being capable of drive the decomposition unit 1, the atomization unit 2 and the stripping unit 3 successively to move to the position just above the organic liquid residues. That is, firstly, the control unit 6 will firstly control the driving mechanism 7, according to the position of the organic liquid residues on the display substrate 5, to drive the decomposition unit 1 to move to the position just above the organic liquid residues. After the organic liquid residues have been decomposed by the decomposition unit 1, the control unit 6 will control the driving mechanism 7 to drive the atomization unit 2 to move to the position just above the organic liquid residues. After the organic liquid residues have been separated from the surface of the display substrate 5 by the atomization unit 2, the control unit 6 will control the driving mechanism 7 to drive the stripping unit 3 to move to the position just above the organic liquid residues. The operational endpoints of the above mentioned decomposition unit 1, the atomization unit 2 and the stripping unit 3 can be determined by setting certain time intervals in the control unit 6. That is, a predetermined time interval is set between the startup of the decomposition unit 1 and the startup of the atomization unit 2, and a predetermined time interval is set between the startup of the atomization unit 2 and the startup of the stripping unit 3. For example, after the decomposition unit 1 has been operated for a determined time interval, the control unit 6 controls the driving mechanism 7 to drive the decomposition unit 1 away from the position just above the organic liquid residues, and at the same time, the control unit 6 controls the driving mechanism 7 to drive the atomization unit 2 to move to the position just above the organic liquid residues.

Figure 5:
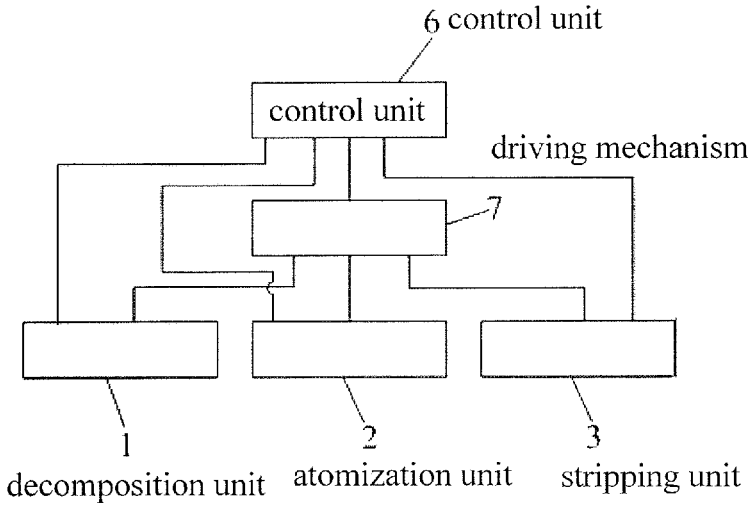
FIG. 5 is a block diagram of another control principle of the control unit in Example 1.

It is to be noted that operational endpoints of the decomposition unit 1, the atomization unit 2 and the stripping unit 3 can also be determined, as shown in FIG. 5, by sending ending signals to the control unit 6 from the decomposition unit 1, the atomization unit 2 and the stripping unit 3 respectively after their operations are finished. Based on the received ending signals, the control unit 6 would control the driving mechanism 7 to drive the present operational unit the operation of which has been finished away from the position just above the organic liquid residues and move the next operational unit to the position just above the organic liquid residues.

The arrangement of the control unit 6 and the driving mechanism 7 enables the organic liquid residues to be treated in a more ordered manner by the decomposition unit 1, the atomization unit 2 and the stripping unit 3, thereby greatly improving the removal efficiency and cleaning quality of the organic liquid residues on the surface of the display substrate 5.

Based on the above structure of the cleaning device, this example also provides a cleaning method for removing organic liquid residues remaining on a surface of the display substrate, which comprises:

Step S1: changing the molecular structures of the organic liquid residues to reduce the adhesive forces of the organic liquid residues on the display substrate;

Step S2: separating the organic liquid residues from Step S1 from the surface of the display substrate;

Step S3: stripping the organic liquid residues from Step S2 from the surface of the display substrate; and Step S4: collecting the organic liquid residues stripped from the surface of the display substrate in Step S3.

In some embodiments of this cleaning method, Step S1 comprises emitting extra-ultraviolet light to the organic liquid residues by an extra-ultraviolet light source, the extra-violet light being capable of decomposing the molecular chains of the organic liquid residues.

In some embodiments of this cleaning method, the extra-ultraviolet light emitted by the extra-ultraviolet light source has a wavelength range of 10 to 40 nm.

In some embodiments of this cleaning method, Step S1 comprises emitting extra-ultraviolet light to the organic liquid residues by a plurality of extra-ultraviolet light sources arranged in a matrix or arranged uniformly in a circular region.

In some embodiments of this cleaning method, Step S2 comprises separating the organic liquid residues from Step S1 from the surface of the display substrate by using an ultrasonic atomizer or an electrostatic atomizer, the ultrasonic atomizer being configured for transmitting ultrasonic wave to the organic liquid residues so as to separate the organic liquid residues from the surface of the display substrate under the vibration action of the ultrasonic wave; and the electrostatic atomizer being configured for charging the surface of the display substrate and the organic liquid residues with electrostatic charges of a same polarity so as to separate the organic liquid residues from the surface of the display substrate under the action of electrostatic repulsion.

In some embodiments of this cleaning method, Step S3 comprises stripping the organic liquid residues from Step S2 from the surface of the display substrate by using a spiral separator, the spiral separator comprises a screw, a chamber sleeved out of the screw and a motor, the chamber having an inlet and an outlet which correspond to two ends of the screw respectively; and the inlet being configured for being arranged towards the organic liquid residues, the motor being configured for rotating the screw around its axis such that the gas stream in the chamber flows from the inlet to the outlet and a negative pressure is formed in the chamber; the spiral separator being capable of sucking the organic liquid residues under the action of the negative pressure in the chamber from the inlet and discharging the same through the outlet.

In some embodiments of this cleaning method, Step S3 is carried out by using a plurality of spiral separators arranged in an array or arranged uniformly in a circular region.

In some embodiments of this cleaning method, Step S4 comprises collecting the organic liquid residues stripped from the surface of the display substrate in Step S3 by using a transparent collection box, the transparent collection box is connected with the outlet through a pipe such that the organic liquid residues discharged from the outlet can enter the transparent collection box through the pipe.

In some embodiments of this cleaning method, the method is carried out by using the cleaning device as described in the present application.

Example 2

This example provides a cleaning device which differs from that in Example 1 in that the atomization unit uses an electrostatic atomizer for charging the surface of the display substrate and the organic liquid residues with electrostatic charges of a same polarity so as to separate the organic liquid residues from the surface of the display substrate under the action of electrostatic repulsion.

The electrostatic atomizer can produce static electricity and charge the surface of the display substrate and the organic liquid residues with electrostatic charges of a same polarity between which a repulsion force exists so as to separate the organic liquid residues from the surface of the display substrate under the action of electrostatic repulsion.

The remaining structure of the cleaning device and the cleaning method based on the cleaning device are the same as those in Example 1 and are not redundantly described herein.

Advantageous Effects of Examples 1 and 2 the cleaning devices provided in Examples 1 and 2 effectively remove organic liquid residues from the surface of the display substrate by arranging the decomposition unit, the atomization unit, the stripping unit and the collection unit, thereby improving the quality of the display substrate.

The embodiment of the invention being thus described, it will be obvious that the same may be varied in many ways. Such variations are not to be regarded as a departure from the spirit and scope of the invention, and all such modifications as would be obvious to those skilled in the art are intended to be included within the scope of the following claims.

The present application claims the priority of the Chinese Patent Application No. 201510017019.1 submitted on Jan. 13, 2015, and the content disclosed in the above Chinese patent application is entirely incorporated by reference as part of this application.

What is claimed is:

1. A cleaning device for removing organic liquid residues remaining on a surface of a display substrate, comprising a decomposition unit, an atomization unit, a stripping unit and a collection unit;

the decomposition unit being configured for changing molecular structures of the organic liquid residues to reduce adhesive forces of the organic liquid residues on the display substrate;

the atomization unit being configured for separating the organic liquid residues which has been treated by the decomposition unit from the surface of the display substrate;

the stripping unit being configured for stripping the organic liquid residues which has been treated by the atomization unit from the surface of the display substrate; and the collection unit being configured for collecting the organic liquid residues stripped by the stripping unit;

wherein the decomposition unit, the atomization unit and the stripping unit are connected with each other;

the stripping unit comprises a spiral separator, and the spiral separator comprises a screw, a chamber sleeved out of the screw and a motor, the chamber having an inlet and an outlet which correspond to two ends of the screw respectively;

the inlet is being arranged towards the organic liquid residues, the motor is configured for rotating the screw around its axis such that a gas stream in the chamber flows from the inlet to the outlet and a negative pressure is formed within the chamber; the spiral separator is capable of sucking the organic liquid residues under action of the negative pressure in the chamber from the inlet and discharging the same through the outlet.

2. The cleaning device as defined according to claim 1, wherein the decomposition unit comprises an extra-ultraviolet light source for emitting extra-ultraviolet light to the organic liquid residues; and the extra-ultraviolet light is capable of breaking down the molecular chains of the organic liquid residues.

3. The cleaning device as defined according to claim 2, wherein the extra-ultraviolet light emitted by the extra-ultraviolet light source has a wavelength range from 10 to 40 nm.

4. The cleaning device as defined according to claim 3, wherein the decomposition unit comprises a plurality of the extra-ultraviolet light sources arranged in a matrix or arranged uniformly in a circular region.

5. The cleaning device as defined according to claim 1, wherein the atomization unit comprises an ultrasonic atomizer or an electrostatic atomizer;

the ultrasonic atomizer is configured for transmitting ultrasonic wave to the organic liquid residues so as to separate the organic liquid residues from the surface of the display substrate under vibration action of the ultrasonic wave; and the electrostatic atomizer is configured for charging the surface of the display substrate and the organic liquid residues with electrostatic charges of a same polarity so as to separate the organic liquid residues from the surface of the display substrate under action of electrostatic repulsion.

6. The cleaning device as defined according to claim 1, wherein the stripping unit comprises a plurality of the spiral separators arranged in an array or arranged uniformly in a circular region.

7. The cleaning device as defined according to claim 6, wherein the collection unit comprises a transparent collection box which is connected with the outlet through a pipe such that the organic liquid residues discharged from the outlet can enter the transparent collection box through the pipe.

8. The cleaning device as defined according to claim 7, wherein the transparent collection box is capable of being disassembled, or alternatively, the transparent collection box is connected with a discharge pipe for the organic liquid residues, such that the organic liquid residues collected in the transparent collection box can be discharged through the discharge pipe.

9. The cleaning device as defined according to claim 1, further comprising a control unit and a driving mechanism, the driving mechanism being connected with the decomposition unit, the atomization unit and the stripping unit respectively, configured for driving the decomposition unit, the atomization unit and the stripping unit to move along the surface of the display substrate; and the control unit being configured for controlling the driving mechanism, according to positions of the organic liquid residues on the display substrate, to drive the decomposition unit, the atomization unit and the stripping unit successively to move to a position immediately above the organic liquid residues; and controlling the driving mechanism to drive the decomposition unit, the atomization unit and the stripping unit respectively to move away from immediately above the organic liquid residues after the organic liquid residues have been treated by the decomposition unit, the atomization unit and the stripping unit.

10. A cleaning method for removing organic liquid residues remaining on a surface of a display substrate, comprising:

Step S1: changing molecular structures of the organic liquid residues to reduce adhesive forces of the organic liquid residues on the display substrate;

Step S2: separating the organic liquid residues from Step S1 from the surface of the display substrate;

Step S3: stripping the organic liquid residues from Step S2 from the surface of the display substrate; and Step S4: collecting the organic liquid residues stripped from the surface of the display substrate in Step S3;

wherein, in Step S3, a spiral separator is used in stripping the organic liquid residues from Step S2 from the surface of the display substrate, the spiral separator comprises a screw, a chamber sleeved out of the screw and a motor, the chamber having an inlet and an outlet which correspond to two ends of the screw respectively; and the inlet is arranged towards the organic liquid residues, the motor being configured for rotating the screw around its axis such that a gas stream in the chamber flows from the inlet to the outlet and a negative pressure is formed in the chamber; the spiral separator being capable of sucking the organic liquid residues under action of the negative pressure in the chamber from the inlet and discharging the same through the outlet.

11. The method according to claim 10, wherein, in Step S1, extra-ultraviolet light is emitted to the organic liquid residues by an extra-ultraviolet light source, the extra-violet light being capable of decomposing the molecular chains of the organic liquid residues.

12. The method according to claim 10, wherein the extra-ultraviolet light emitted by the extra-ultraviolet light source has a wavelength range from 10 to 40 nm.

13. The method according to claim 12, wherein, in Step S1, extra-ultraviolet light is emitted to the organic liquid residues by a plurality of extra-ultraviolet light sources arranged in a matrix or arranged uniformly in a circular region.

14. The method according to claim 10, wherein, in Step S2, an ultrasonic atomizer or an electrostatic atomizer is used in separating the organic liquid residues from Step S1 from the surface of the display substrate, the ultrasonic atomizer is configured for transmitting ultrasonic wave to the organic liquid residues so as to separate the organic liquid residues from the surface of the display substrate under vibration action of the ultrasonic wave; and the electrostatic atomizer is configured for charging the surface of the display substrate and the organic liquid residues with electrostatic charges of a same polarity so as to separate the organic liquid residues from the surface of the display substrate under action of electrostatic repulsion.

15. The method according to claim 10, wherein Step S3 is carried out by using a plurality of spiral separators arranged in an array or arranged uniformly in a circular region.

16. The method according to claim 15, wherein, in Step S4, a transparent collection box is used in collecting the organic liquid residues stripped from the surface of the display substrate in Step S3, the transparent collection box is connected with the outlet through a pipe such that the organic liquid residues discharged from the outlet can enter the transparent collection box through the pipe.

17. The method according to claim 10, wherein the method is carried out by using the cleaning device as defined in claim 1.

* * * * *